US008754585B1

(12) United States Patent
Bahrehmand

(10) Patent No.: US 8,754,585 B1
(45) Date of Patent: Jun. 17, 2014

(54) LED DRIVER AND INTEGRATED DIMMER AND SWITCH

(76) Inventor: Farhad Bahrehmand, Seven Hills, OH (US)

( * ) Notice: Subject to any disclaimer, the term of this patent is extended or adjusted under 35 U.S.C. 154(b) by 398 days.

(21) Appl. No.: 12/324,200

(22) Filed: Nov. 26, 2008

Related U.S. Application Data

(60) Provisional application No. 61/005,068, filed on Nov. 30, 2007.

(51) Int. Cl.
*H05B 37/02* (2006.01)

(52) U.S. Cl.
USPC ..... 315/291; 315/287; 315/312

(58) Field of Classification Search
USPC ..... 315/291, 307, 308, DIG. 4; 323/318, 323/351
See application file for complete search history.

(56) References Cited

U.S. PATENT DOCUMENTS

| | | | | |
|---|---|---|---|---|
| 3,103,618 | A * | 9/1963 | Slater | 323/327 |
| 5,357,566 | A | 10/1994 | Dowling et al. | |
| 5,920,309 | A | 7/1999 | Bisset et al. | |
| 6,304,039 | B1 * | 10/2001 | Appelberg et al. | 315/169.3 |
| 6,402,354 | B1 * | 6/2002 | Tatewaki et al. | 362/490 |
| 6,940,733 | B2 | 9/2005 | Schie et al. | |
| 6,963,175 | B2 * | 11/2005 | Archenhold et al. | 315/291 |
| 7,145,295 | B1 | 12/2006 | Lee et al. | |
| 7,164,238 | B2 * | 1/2007 | Kazanov et al. | 315/209 SC |
| 7,242,393 | B2 | 7/2007 | Caldwell | |
| 7,358,685 | B2 * | 4/2008 | Lee | 315/287 |
| 7,557,521 | B2 * | 7/2009 | Lys | 315/294 |
| 7,609,008 | B1 | 10/2009 | Kohler | |
| 2002/0060530 | A1 * | 5/2002 | Sembhi et al. | 315/291 |
| 2003/0137258 | A1 | 7/2003 | Piepgras et al. | |
| 2003/0227375 | A1 | 12/2003 | Yong | |
| 2004/0212321 | A1 | 10/2004 | Lys et al. | |
| 2005/0116662 | A1 * | 6/2005 | Sanchez | 315/225 |
| 2005/0225264 | A1 * | 10/2005 | Kemp | 315/291 |
| 2006/0076908 | A1 * | 4/2006 | Morgan et al. | 315/312 |
| 2006/0113975 | A1 | 6/2006 | Mednik et al. | |
| 2007/0052376 | A1 * | 3/2007 | Lee | 315/312 |
| 2007/0124632 | A1 | 5/2007 | Chung et al. | |
| 2007/0182347 | A1 * | 8/2007 | Shteynberg et al. | 315/312 |
| 2007/0267984 | A1 * | 11/2007 | Peng | 315/312 |
| 2008/0018261 | A1 * | 1/2008 | Kastner | 315/192 |
| 2008/0192499 | A1 * | 8/2008 | Gardner et al. | 362/488 |
| 2008/0285271 | A1 | 11/2008 | Roberge et al. | |
| 2009/0015174 | A1 * | 1/2009 | Huang et al. | 315/250 |

(Continued)

OTHER PUBLICATIONS

Texas Instruments, Inc., "Mixed Signal Microcontroller", MSP430X11X1, SLAS241C, Sep. 1999, Revised Jun. 2000, pp. 1-45.

(Continued)

*Primary Examiner* — Douglas W Owens
*Assistant Examiner* — Henry Luong

(57) ABSTRACT

An LED driver includes an LED driver circuit adapted to receive a 110 volt AC current and to rectify the AC current into a low voltage DC output current; a PWM generator including control means to generate a PWM signal with an adjustable duty cycle; means operatively connecting the PWM generator to the LED driver circuit to provide the driver circuit with the PWM signal, the LED driver circuit generating a fixed frequency pulse in which the pulse width is modulated proportional to the PWM signal duty cycle to control LED brightness, wherein the driver circuit, the PWM generator and the connecting means are sized to fit within a standard 110 volt AC outlet box.

10 Claims, 7 Drawing Sheets

(56) References Cited

U.S. PATENT DOCUMENTS

| | | | | |
|---|---|---|---|---|
| 2009/0079355 | A1* | 3/2009 | Zhou et al. | 315/246 |
| 2009/0146583 | A1* | 6/2009 | Bhadri et al. | 315/294 |
| 2009/0224686 | A1* | 9/2009 | Kunimatsu | 315/291 |
| 2010/0052577 | A1 | 3/2010 | Brownlee | |
| 2011/0018465 | A1 | 1/2011 | Ashdown | |

OTHER PUBLICATIONS

CTS, "Commercial Miniature 5/8, (16MM) Diameter Composition Variable Resistors", Oct. 2006, CTS Corp., pp. 1-6.

National Semiconductor, "LM 555 Timer", Jul. 2006, pp. 1-12.

* cited by examiner

LED DRIVER AND INTEGRATED DIMMER AND SWITCH

BACKGROUND OF THE INVENTION

1. Technical Field

The present invention relates to a driver and dimmer/switch therefore for an array of light emitting diodes (LED's).

2. Brief Description of the Prior Art

LED is abbreviation of "Light Emitting Diode", which is a small electronic device that lights up when an electric current is passed through it. The term diode refers to a family of two-pin semiconductor devices. The current can pass through them only in one direction. The first LED's were red. They were introduced to the market decades ago. The early red LED's quickly found applications as tiny indicators on audio equipment, TV's, and even digital wrist watches. Later, LED's were used as seven-segment display modules, and the first pocket calculators used them. Years of research has introduced all sorts of colorful LED's to the market. The most common LED's are red, green, yellow, blue, and orange. The color of LED is due to the material used in the LED chip not just the color of the package. In the past several years, the LED market has seen a big jump in the brightness of the LED's, and white LED's have been introduced that produce enough light that they have been used in cars and general lighting.

The main advantages of LED's are long life span (some exceeding 100,000 hours), and high efficiency compared to small tungsten or incandescent lights. Additionally, they generate very little heat when they are operated at the rated current. They can also take a harsh environment, as there is no filament in them. The disadvantages (at least when compared to 110V tungsten light bulbs) are that they can not directly replace incandescent lamps, and, a single LED is very small and generally cannot generate enough light to light up a room. Therefore, the LED's for generating a large amount of light are typically used in clusters. Some designers used them in series strings, some use them in parallel strings, and some use them in a combination of series and parallel strings.

The LED's are normally used in constant-current circuits. The early LED's required only 10 milliamperes to operate. Many new ultra-bright white LED arrays require a current of 750 milliamperes to operate at maximum brightness.

The term "LED driver" refers to any kind of electronic circuit that produces the current and voltage necessary to turn on a specific LED or cluster of LED's. For example, some LED drivers can take as input the 12VDC from a car battery, and generate enough current to turn on a combination cluster of 20 LED's used in a tail light. Another example is an LED driver that turns on a combination of LED clusters used as the backlighting for flat panel LCD displays (the LED's have effectively replaced the fluorescent back lighting).

The LED driver for commercial and residential lighting is different because the input voltage will typically be 110 volts AC. This voltage needs to be converted to DC and also it needs to be regulated such that it does not feed more than the necessary amount of current to the LED's. If the LED's are driven by higher currents and voltage than their rated values, their life span will significantly shorten or they may even burn out quickly.

Currently, lighting fixture companies use LED drivers for fixtures such as chandeliers that are so large they can barely fit into the ceiling or fixture canopy. The drivers also do not have any onboard or external dimmer. It has been proposed to use a conventional incandescent 110 volt AC dimmer for dimming LED's. This is an awkward way of solving the problem because two units have to be installed, one in the ceiling and one in the wall outlet for the fixture. In addition, there are compatibility issues between LED drivers and incandescent dimmers.

Published US application 2004/0212321 discloses an LED driver configured to provide power from an Ac 110 volt circuit to a plurality of LED's. The driver gets its power from rectified standard AC voltage. Further, a conventional AC dimmer is used for dimming functionality.

Published US application 2006/0113975 discloses controlling output current of a DC/DC converter. While this circuit could be employed in an LED driver, it does not disclose the technology of the present invention.

U.S. Pat. No. 6,940,733 discloses a power supply using a frequency modulated pulse train for optimal power conversion. The circuitry of the present invention employs a fixed frequency.

U.S. Pat. No. 7,145,295 discloses a simple design for controlling light emitting diodes. While this design could be used for dimming LED's, it does not disclose a technology as how to power, dim, and switch LED's on/off in an offline application that could also be fit in an AC outlet for lighting applications.

Published Data Sheet HV9910 titled "Universal High Brightness LEDDriver" by Supertex, Inc, 1235 Bordeaux Drive, Sunnyvale, Calif., 94089, discloses a PWM high efficiency LED driver control IC. It allows efficient operation of High Brightness (HB) LED's from voltage sources ranging from 8VDC up to 450VDC. The HV9910 controls an external MOSFET at fixed switching frequency up to 300 kHz. The frequency can be programmed using a single resistor. The LED string is driven at constant current rather than constant voltage, thus providing constant light output and enhanced reliability. The output current can be programmed between a few milliamps and up to more than 1.0 A. The HV9910 uses a rugged high voltage junction isolated process that can withstand an input voltage surge of up to 450V. Output current to an LED string can be programmed to any value between zero and its maximum value by applying an external control voltage at the linear dimming control input of the HV9910. The HV9910 provides a low-frequency PWM dimming input that can accept an external control signal with a duty ratio of 0-100% and a frequency of up to a few kilohertz.

SUMMARY OF THE INVENTION

The present invention resides in an integrated LED driver with on-board dimmer and on/off switch capable of driving a string of LED's and sized to fit within a standard AC outlet box, e.g. 2"×3½"×2½" deep.

More specifically, the present invention resides in an LED driver that comprises an LED driver circuit adapted to receive a 110 volt AC current and to rectify said current into a low voltage rectified DC output current. A PWM generator including control means is operatively connected to the LED driver circuit to provide a PWM pulse signal to the LED driver circuit, said pulse signal having a variable duty cycle controlled by said control means. The LED driver circuit generates a fixed frequency pulse in which the pulse width is modulated proportional to the PWM pulse signal to control LED brightness. The PWM generator control means includes an on/off switch. The LED driver circuit and PWM generator are sized to fit within a standard 110 volt AC current outlet box.

In the LED driver of the present invention, the PWM generator is powered by a low voltage DC current. The LED driver further comprising a lead between said LED driver circuit and said PWM generator to provide a low voltage low power DC input from said circuit to said PWM generator.

The LED driver circuit and PWM generator are preferably integrated into a small packaged unit adapted to fit within a standard AC 110 volt outlet box.

In one embodiment, the LED driver of the present invention is sold with an LED chandelier. The LED chandelier has a cluster of LED's large enough to provide conventional chandelier lighting. The LED driver of the present invention has the capacity to power such large number of LED's. The buyer pulls out the old AC power switch from its AC outlet box and installs the LED driver of the present invention. The control on the driver is used to turn the chandelier ON/OFF as well as dim the chandelier.

In one embodiment, the PWM generator is analog and comprises a potentiometer.

In another embodiment, the PWM generator is digital and comprises a microprocessor.

BRIEF DESCRIPTION OF THE DRAWINGS

The present invention and advantages thereof will become more apparent from the following description with reference to the accompanying drawings, in which.

DETAILED DESCRIPTION OF THE PRESENT INVENTION

Figure 1:
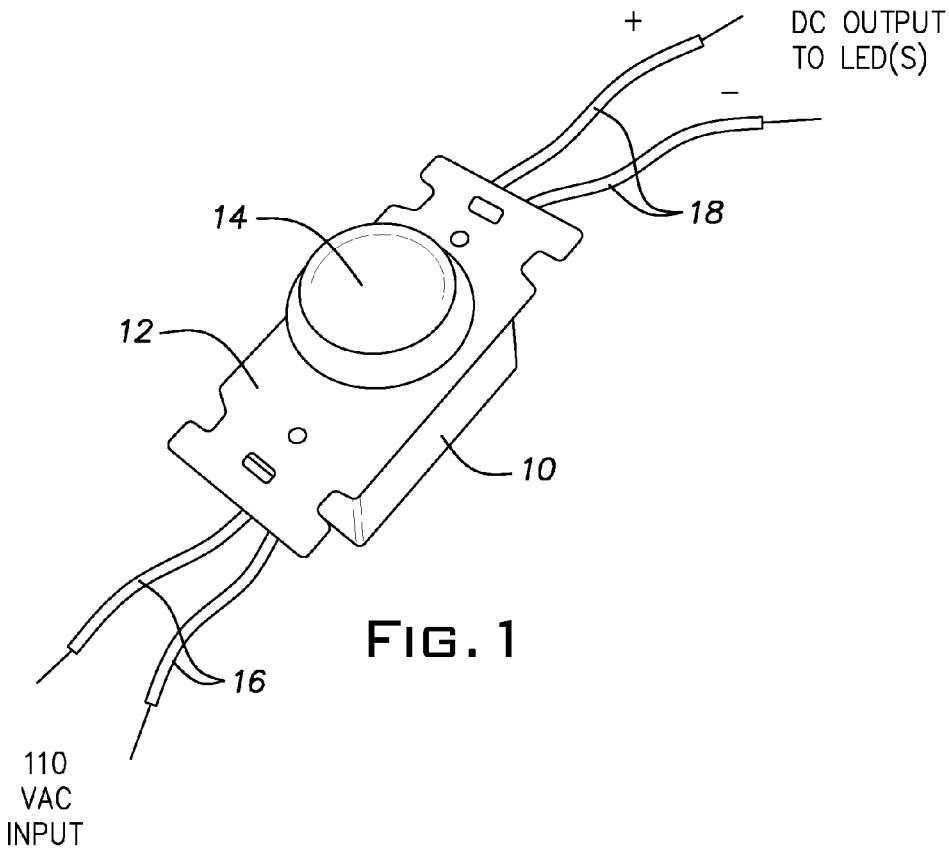
FIG. 1 depicts the present invention using an integrated analog PWM generator comprising a potentiometer knob to dim the LED(s). The same knob is used to turn the LED(s) off by turning it all the way counter-clockwise.

Referring to FIG. 1, the overall appearance of one embodiment of the LED driver with an integral driver and switch is shown. FIG. 1 comprises a small enclosure 10, a mounting bracket 12, a potentiometer control knob 14, 110 volt AC input leads 16, and low voltage DC output leads 18. The output leads 18 extend to one or more LED's (not shown), for instance a chandelier comprising a string of LED's.

The enclosure 10 houses all the components of this embodiment of the invention and is small enough to fit into a standard AC outlet. The enclosure 10 should be made of a code approved material, and is attached to the mounting bracket 12. The mounting bracket 12 secures the assembly onto a standard AC outlet using two or more screws (not shown). The mounting bracket 12 should be made of a thin metal, such as aluminum, such that it can be grounded for safety (grounding wire not shown). The knob 14 is mounted on a potentiometer with an onboard switch (to be described). Turning the knob 14 clockwise increases the brightness of the Led(s). If the knob 14 is turned all the way counter-clockwise, the onboard switch (not shown) clicks open and turns the LED(s) off. It should be noted that the potentiometer can be wired in a manner that turning knob 14 clockwise reduces the brightness of the LED(s). This may be appealing to many, because when the dimmer is turned ON, the LED's are at full brightness; thus, turning the knob 14 clockwise reduces the brightness. A faceplate (not shown) should cover the installed unit. The faceplate may have a custom color and design to match existing room decorations.

Figure 2:
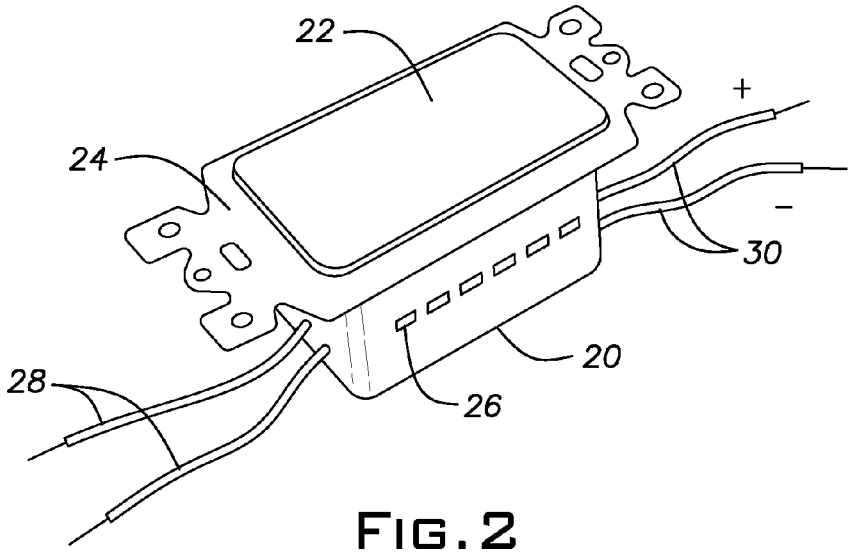
FIG. 2 depicts the present invention using an integrated digital PWM generator comprising a switch plate to dim the LED(s) or turn them on or off.

FIG. 2 shows another embodiment of the present invention that could be used for switching LED(s) ON/OFF, as well as dimming them. FIG. 2 shows a small enclosure 20, a flat switch plate 22 mounted on one or more small push-button switches (to be described), a mounting bracket 24, power line leads 28, and LED output leads 30. Openings 26 permit air circulation for cooling the components in the enclosure 20.

The enclosure 20 is attached to the mounting bracket 24 such that the unit can be installed into a standard AC outlet box. The mounting bracket 24 preferably is made of a thin metal such that it can be grounded for safety (grounding wire not shown). The flat switch plate 22 is positioned in the mounting bracket 24 such that it can toggle one or more small switches that reside underneath (not shown). The switch(s) are used for dimming as well as turning the LED(s) ON or OFF. In one embodiment, a single push-button switch is mounted under the switch plate. It can toggle the LED(s) as well as dim them. A single press on the switch plate 22 toggles the LED(s), while pressing and holding the switch plate 22 dims the LED(s). The leads 28 connect to 110V AC power lines. The leads 30 are the DC output leads, which connect to one or more LED's.

There are two methods for dimming LED's: analog, and PWM (pulse width modulation). Analog dimming is achieved by reducing the current in the LED's. PWM dimming is achieved by reducing the duty cycle of the applied PWM current while keeping the current in the LED's at a maximum. Analog dimming in chandeliers for lighting has a major drawback, namely an LED color shift. Lowering the LED current causes a subtle change in radiant wavelength. As such, PWM dimming is the preferred method of dimming LED's used in the lighting industry because the LED current remains constant as the LED's are dimmed. The present invention employs PWM dimming.

Figure 3:
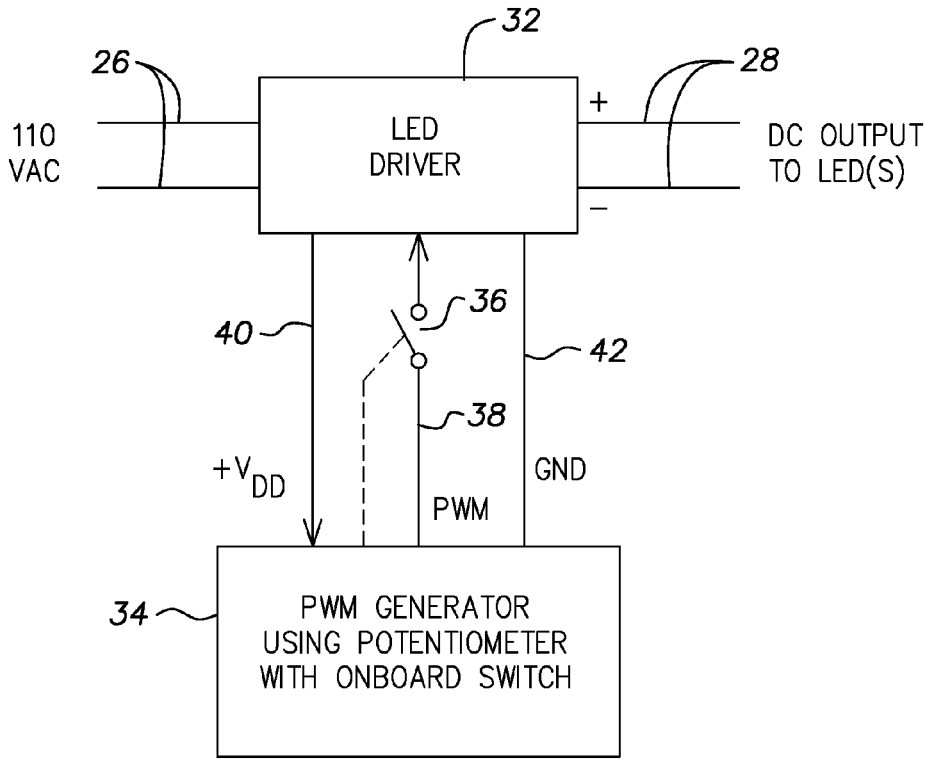
FIG. 3 is a simplified block diagram of the LED driver of FIG. 1 using an analog PWM generator.

Referring to FIG. 3, there is shown a simplified block diagram of the embodiment of FIG. 1. The assembly shown in FIG. 3 comprises of a LED driver 32, a PWM generator 34, and an onboard ON/OFF switch 36 in lead 38. By onboard, it is meant that the switch 36 is an integral part of a potentiometer (to be described) or is physically connected so that it is responsive to the potentiometer. The LED driver 32 and the PWM generator 34 are operatively connected via the ON/OFF switch 36. The PWM generator 34 transmits PWM pulses to the LED driver 32 if the ON/OFF switch 36 is closed. The duty cycle of the PWM generator 34 sets the brightness of the LED(s).

The PWM generator 34 comprises a PWM circuit (to be described) and the above-mentioned potentiometer with an onboard switch 36. The potentiometer comprises the control knob 14 (shown in FIG. 1) that if turned changes the duty cycle of the PWM pulses transmitted to the LED driver 32 in lead 38. The driver 32 has power input leads 16 (FIGS. 1 and 3) that allow it to be connected to 110V AC power lines. The driver 32 also has output leads 18 (FIGS. 1 and 3) that are connected to one or more LED's (not shown). The LED driver 32 has circuitry (to be described) that rectifies the 110 volt AC input power to a rectified low voltage DC power. The PWM generator 34 is powered by the low DC voltage obtained from driver 32 via lead 40. The lead 42 is used as the ground reference for the small DC voltage in lead 40 as well as the ground reference for PWM pulses in lead 38.

The switch 36 is in series with the PWM output lead 38 such that if the knob 14 (FIG. 1) is turned all the way counter clockwise the switch 36 (FIG. 3) clicks open and the PWM output cuts off, turning off the LED's. It is possible to use switch 36 in other arrangements to turn the LED's off. For example, switch 36 could be placed in series with output leads 18, or in the LED driver circuit. Positioning the switch 36 in series with the 110 volt AC input leads 16 is not preferred because switching high levels of voltage or current reduces the life span of a switch due to the occurrence of arcing between its contacts. It should be noted that the switch 36 and potentiometer could be two separate components. For instance, an ON/OFF toggle switch could turn the LED's on and off, while a plain potentiometer dims the LED's by changing the duty cycle of the pulse generated by the PWM generator 34.

Figure 4:
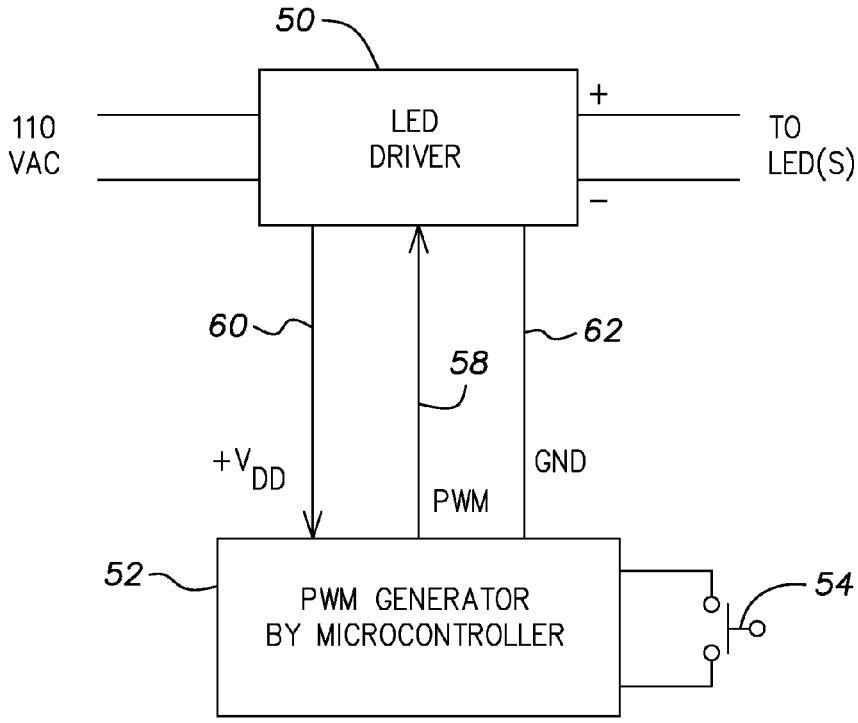
FIG. 4 is a simplified block diagram of the LED driver of FIG. 2 using a microcontroller-based PWM generator and a single push-button momentary switch.

Referring to FIG. 4, there is shown a simplified block diagram of the embodiment of FIG. 2. The assembly of FIG. 4 comprises an LED driver 50, a PWM generator 52 and a push-button switch 54. The PWM generator comprises a microcontroller (to be described).

The LED driver 50 and the PWM generator 52 are operatively connected by a PWM pulse lead 58 that sends PWM pulses from the PWM generator 52 to the LED driver 50. The PWM generator 52 comprises a PWM circuit (to be described) and the push-button switch 54. The push-button switch 54 is onboard in the sense that it is physically located under switch plate 22 (FIG. 2). The closure status of the push-button switch 54 is monitored by the microcontroller in the PWM circuit. The microcontroller is programmed to detect short and long closures of the push-button switch 54. In response to a short closure of push-button switch 54, the microcontroller toggles the transmission of PWM pulses to driver 50 in lead 58. If there is a PWM transmission of PWM signals in lead 58, the LED's turn on; otherwise, the LED's are off. If push-button switch 54 is held closed for about a second or more (i.e. long closure), the microcontroller detects this long closure and changes the duty cycle of PWM pulses in lead 58. The direction in which the duty cycle of the PWM pulses changes depends on the previous direction of the duty cycle change. If the previous long closure of push-button 54 caused an increase of the duty cycle of the PWM pulses, the next long closure causes a decrease of duty cycle of the PWM pulses in lead 48. Increasing the duty cycle of the PWM pulses increases the brightness of LED's connected to driver 50 and vise versa. The driver 50 has power leads 28 that allow it to be connected to 110V AC power lines. The driver 50 also has output leads 30 that are connected to one or more LED's (not shown).

The PWM generator 52 is powered by low supply voltage obtained from the LED driver via connecting lead 60. This allows the driver 50 and PWM generator 52 to be integrated into and assembled together into a small enclosure that fits within a standard 110V AC outlet box.

Figure 5:
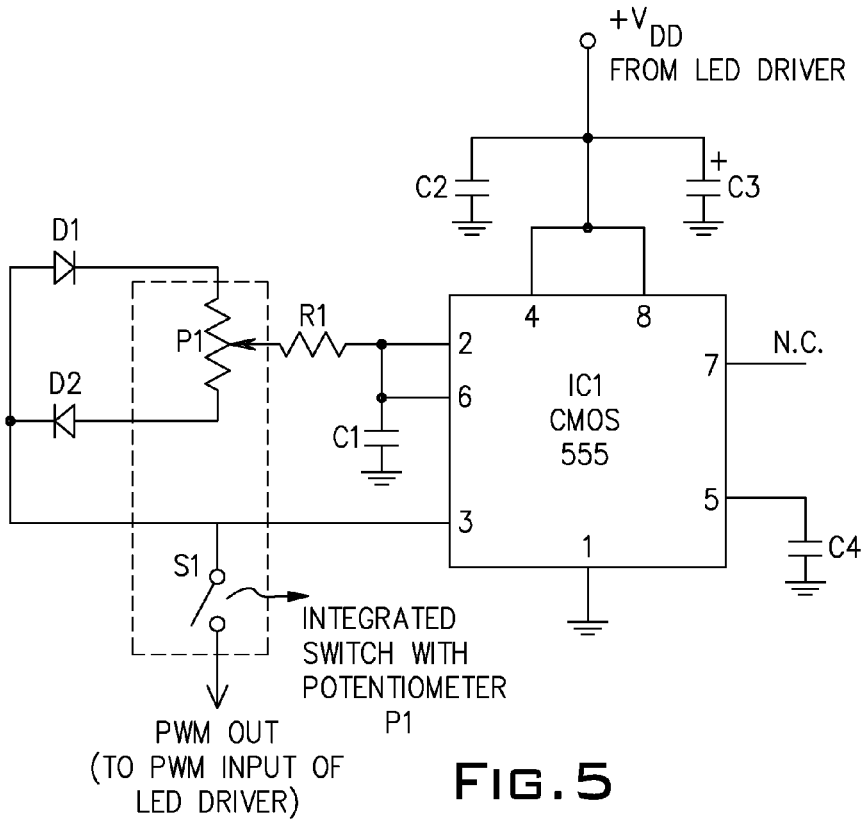
FIG. 5 is a schematic view of the analog PWM generator circuitry of FIG. 3 in accordance with one embodiment of the present invention.
Figure 6:
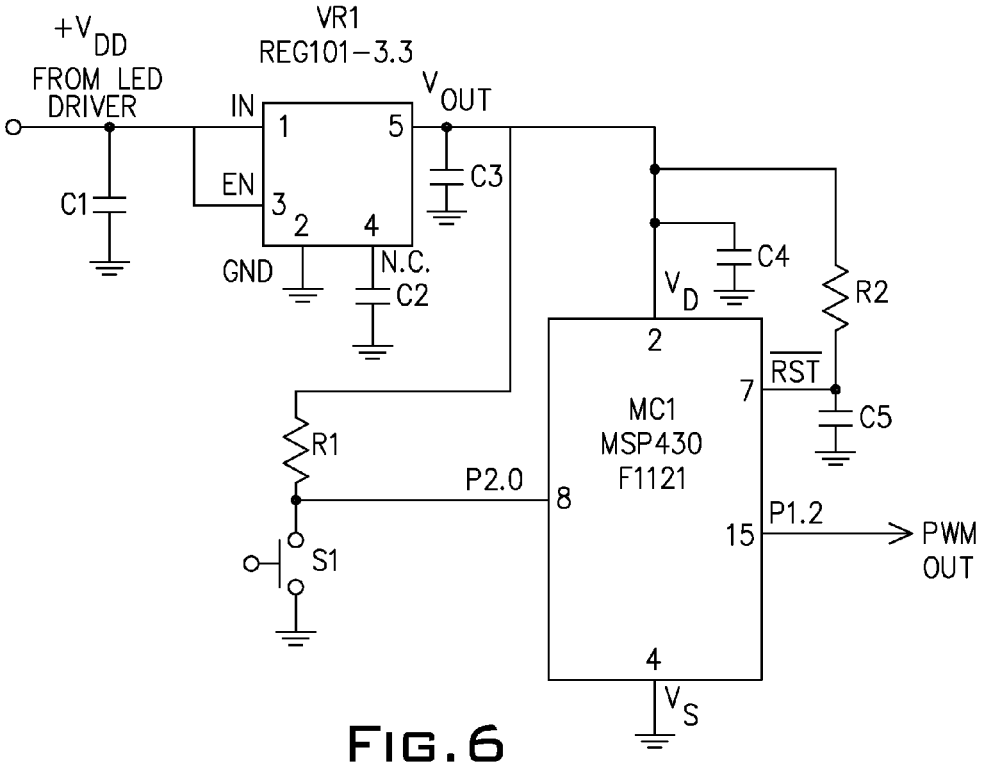
FIG. 6 is a schematic view of the digital PWM generator circuitry of FIG. 4 in accordance with another embodiment of the present invention.

FIG. 5 and FIG. 6 show two very low power consumption PWM generators that get their power directly from the LED driver circuit. FIG. 5 is an analog PWM generator, used in the assembly of FIGS. 1 and 3, while FIG. 6 is a digital PWM generator used in the assembly of FIGS. 2 and 4.

The analog PWM generator circuit in FIG. 5 is designed around a 555 CMOS integrated circuit chip. The design has advantages of very low power consumption, low component count, and low cost. The very low power consumption allows it to be directly connected to the low DC voltage available from LED driver circuit.

The 555 integrated circuit (IC) is a versatile integrated circuit marketed by National Semiconductor for generating accurate time delays or oscillation. The frequency of oscillation is fixed and determined by the value of capacitor C1, resistor R1, and potentiometer P1 using the equation f=1.44/((P1+R1)*C1)

The duty cycle can be varied by adjusting the potentiometer P1. The potentiometer P1 is a Series 270 variable resistor marketed by CTS Corporation. Switch S1 (36 in FIG. 3), is integrated with potentiometer P1 and is used to turn the PWM output on/off. Diodes D1 and D2 are used to set the charge/discharge path of capacitor C1 through P1 and R1. Capacitors C2 and C3 are decoupling capacitors to eliminate noise from getting into the 555 integrated circuit through VDD supply lead 40. Capacitor C4 helps eliminate noise from the internal reference of the integrated circuit.

FIG. 6 shows a digital PWM generator designed around an ultra-low-power microcontroller MC1. The microcontroller (MC1) is marketed by Texas Instruments under the trade designation MSP430. The microcontroller (MC1) is programmed to monitor the status of the momentary push-button (S1) for short and long closures. In response to a short closure of switch (S1), microcontroller (MC1) toggles the transmission of PWM pulses through digital output pin (P1.2). The digital output pin (P1.2) is connected to the PWM input of the LED driver (not shown). Toggling transmission of PWM pulses in P1.2 toggles the LED's on/off. If the switch (S1) is held closed for about a second or more, the microcontroller (MC1) changes the duty cycle of the PWM pulses in P1.2 according to its embedded program. The direction in which the duty cycle of PWM changes depends on the previous direction of change in the duty cycle. If the previous long closure of switch (S1) caused an increase of the PWM duty cycle, the next long closure of switch (S1) causes a decrease of the duty cycle. Increasing the duty cycle of PWM increases the brightness of LED's connected to the driver and vise versa.

The low DC voltage input $V_{DD}$ from the LED driver circuit may need to be further lowered before powering the microcontroller circuit. In FIG. 6, a low-dropout regulator (VR1) is employed to reduce the PWM supply voltage from the driver circuit to +3.3V. This can also be done by a zener diode or by a simple resistive circuit.

Capacitor C1, and C3 decouples noise from the voltage regulator VR1. C4 decouples noise from the voltage supplied to microcontroller (MC1). Resistor (R2) and capacitor (C5) form a "power-up reset" circuit to reset the microcontroller (MC1) upon power-up through the (RST) pin. Microcontroller (MC1) has onboard oscillators and clock-modules for handling timings and running the embedded program. It is possible to attach an external crystal or resonator for more precision timings. Switch (S1) is preferably a small, surface-mount momentary switch functioning as an actuator for the digital PWM generator. The operator dims or toggles the LED's by clicking switch (S1). It is possible to employ more than one switch for controlling the dimming direction of LED's. Almost all microcontrollers provide at least four digital pins that could be used for input or output assignments.

Figure 7:
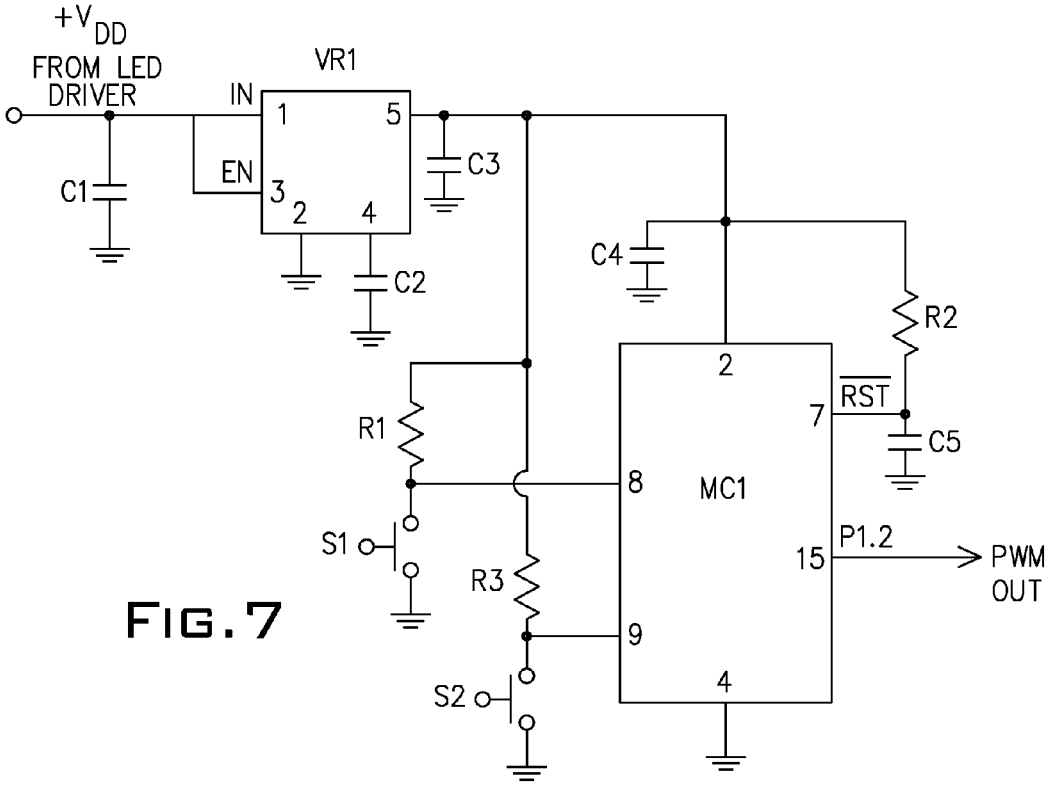
FIG. 7 is a schematic view of another digital PWM generator in accordance with yet another embodiment of the present invention.

FIG. 7 is yet another embodiment of the digital PWM generator that could be employed by the present invention. The PWM generator shown in FIG. 7 is a replica of the PWM generator described in FIG. 6 except for the extra switch (S2) and pull-up resistor (R3). The circuit operation is very flexible as the microcontroller (MC1) controls all the operation of monitoring the switches and generating PWM signals. One possible example for operation of the circuit of FIG. 7 is briefly explained. If either (S1) or (S2) are pressed momentarily, the LED's will turn ON or OFF depending on the previous state. If switch (S1) is held for a second or more, the brightness will increase until the switch (S1) is released. If switch (S2) is held for a second or more, the LED's will dim until the switch (S2) is released. The microcontroller stores the level of brightness after each interaction. Both switches S1 and S2 can be mounted in the faceplate of a standard 110 volt AC outlet box.

Figure 8:
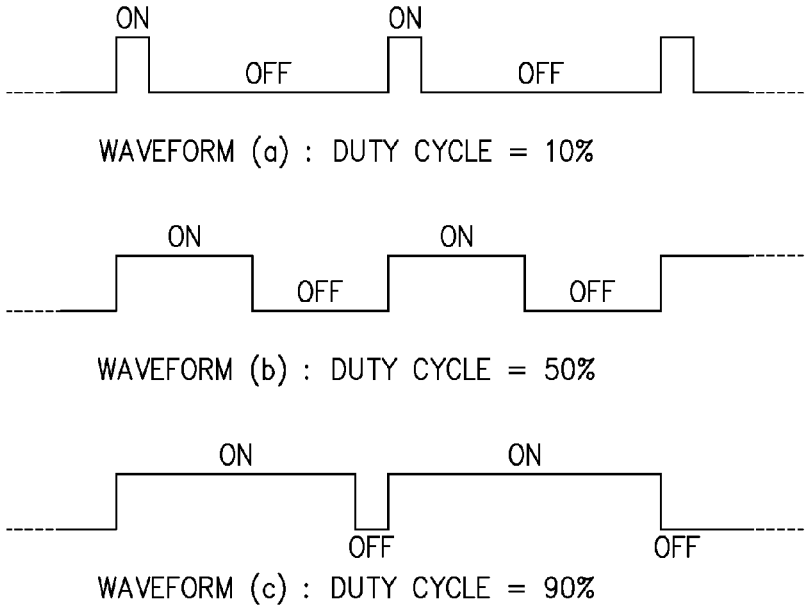
FIG. 8 depicts the pulse waveforms of the circuitry of the PWM generator circuits of FIG. 5, FIG. 6, and FIG. 7.

FIG. 8 shows three examples of pulse width modulated (PWM) signals. Pulse width modulation is the process of switching a DC voltage ON and OFF at a given or fixed frequency, with varying ON and OFF times. These ON and OFF times are referred to as the "duty cycle", which is defined as the ratio of the ON time of the PWM signal to its period (period being the time of one complete cycle). The PWM signal is transmitted to the LED driver in the PWM lead for the purpose of dimming. The LED's are dimmed by reducing the duty cycle of the PWM signal. The more the ON-time, the brighter the LED's. The PWM generators of the present invention are able to adjust the duty cycle form less than 1% to more than 99%. When the duty cycle is at 1%, the LED's are very dim, and when the duty cycle is more than 99%, the LED's are fully lit. If the frequency of the PWM signal is high enough, the LED's appear at a flicker free brightness to human eyes. The PWM signal is applied at a frequency higher than 100 Hz. Our eyes cannot detect this fast switching.

As can be seen from the waveform (a) in FIG. 8, a PWM signal with a 10% duty cycle is on for only 10% of a whole cycle, which means the LED's will be on for only 10% of the period. Waveform (b) in FIG. 5 shows a PWM signal with a 50% duty cycle. Increasing the duty cycle of the PWM signal from 10% to 50% increases the brightness of the LED's, because the LED's will be on for 50% of the period. Waveform (c) in FIG. 5 shows a PWM signal with a duty cycle of 90%. Applying a PWM signal with a duty cycle of 90% to the LED driver will turn on the LED's to en even higher brightness.

Figure 9:
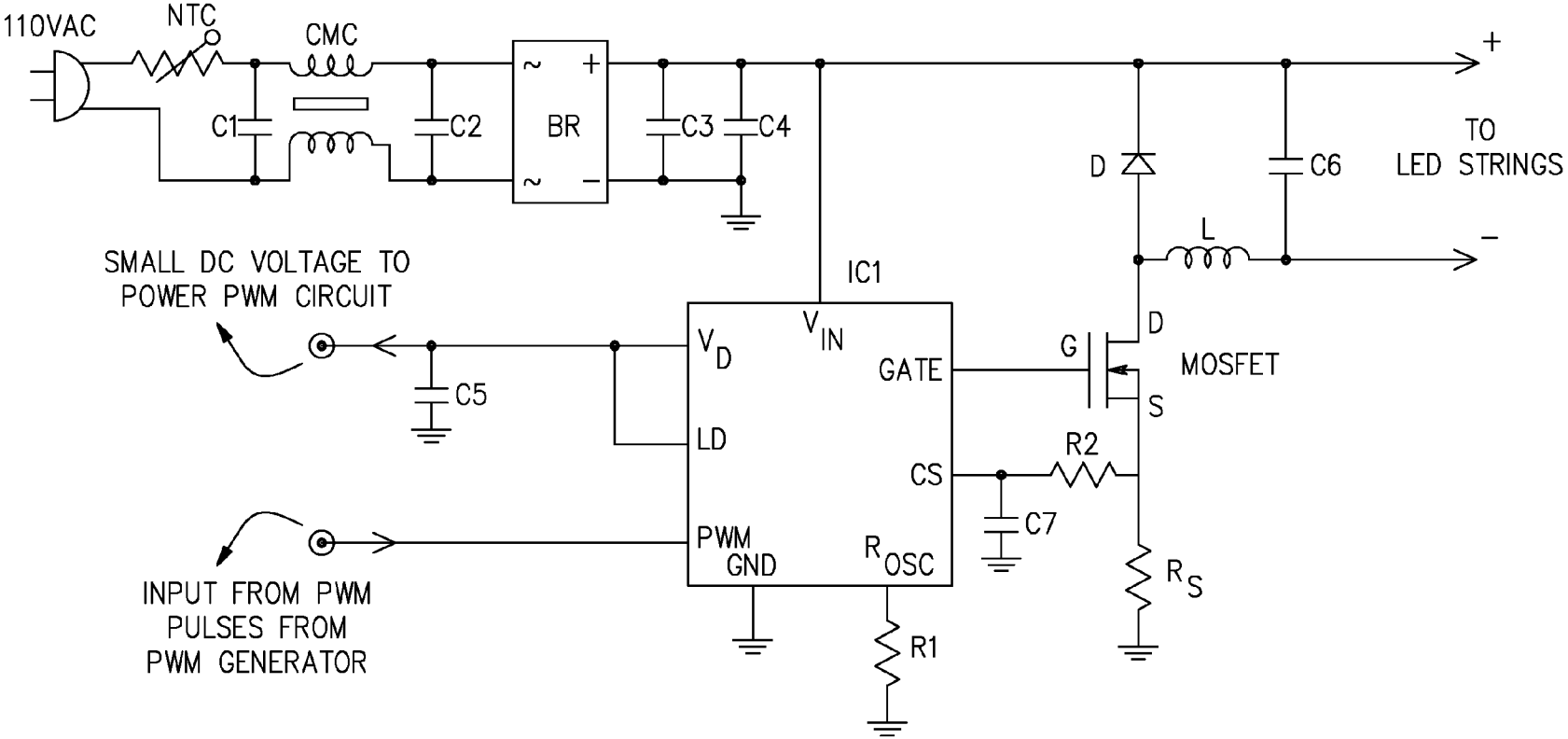
FIG. 9 is a schematic view of the driver circuitry in accordance with an embodiment of the present invention.

FIG. 9 shows an offline LED driver circuit useful with the PWM generator circuits of FIGS. 6, 7, and 8. The driver circuit also provides a low voltage current that is useful in powering the PWM generator circuits. The LED driver circuit shown in FIG. 9 is a DC-DC switching converter called a buck-converter. The term "buck" refers to DC-DC switching converters that convert a high DC voltage to a low DC voltage. The circuit of FIG. 9 has been designed around an HV9910 integrated circuit (IC1) marketed by Supertex Inc. The operation of the LED HV9910 integrated circuit is explained in detail in the HV9910 data sheets, incorporated by reference herein. Dimming is accomplished by applying the PWM signal to the PWM pin. This signal enables and disables the converter modulating the LED current in the PWM fashion. Thus the LED current is in one of two states; zero or the nominal current set by the current sense resistor. As it can be seen in FIG. 9, the integrated circuit (IC1) generates a small DC voltage (pin $V_{DD}$) that is used to power the PWM generator of FIGS. 6, 7, and 8. The IC1 circuit accepts PWM signals for dimming at pin "PWM".

Switching of the output current in FIG. 9 is by means of transistor MOSFET. The term MOSFET stands for Metal Oxide Semiconductor Field Effect Transistor. It is a sensitive low loss transistor that is used in high speed switching. Conventional transistors dissipate a lot of energy when used as a switch. The dissipation is mainly due to junction resistance and capacitance among other things. MOSFETS have very low ON resistance and capacitance. However, some heat is generated due to the passage of current in the MOSFET and in the present invention, the MOSFT is mounted on a heat sink to cool it. The heat sink is a small piece of aluminum with fins. The CMC (common-mode choke) is a miniature transformer that absorbs common mode signals and thus suppresses noise and reduces the interference between the LED driver and other devices attached to other outlets.

Figure 10:
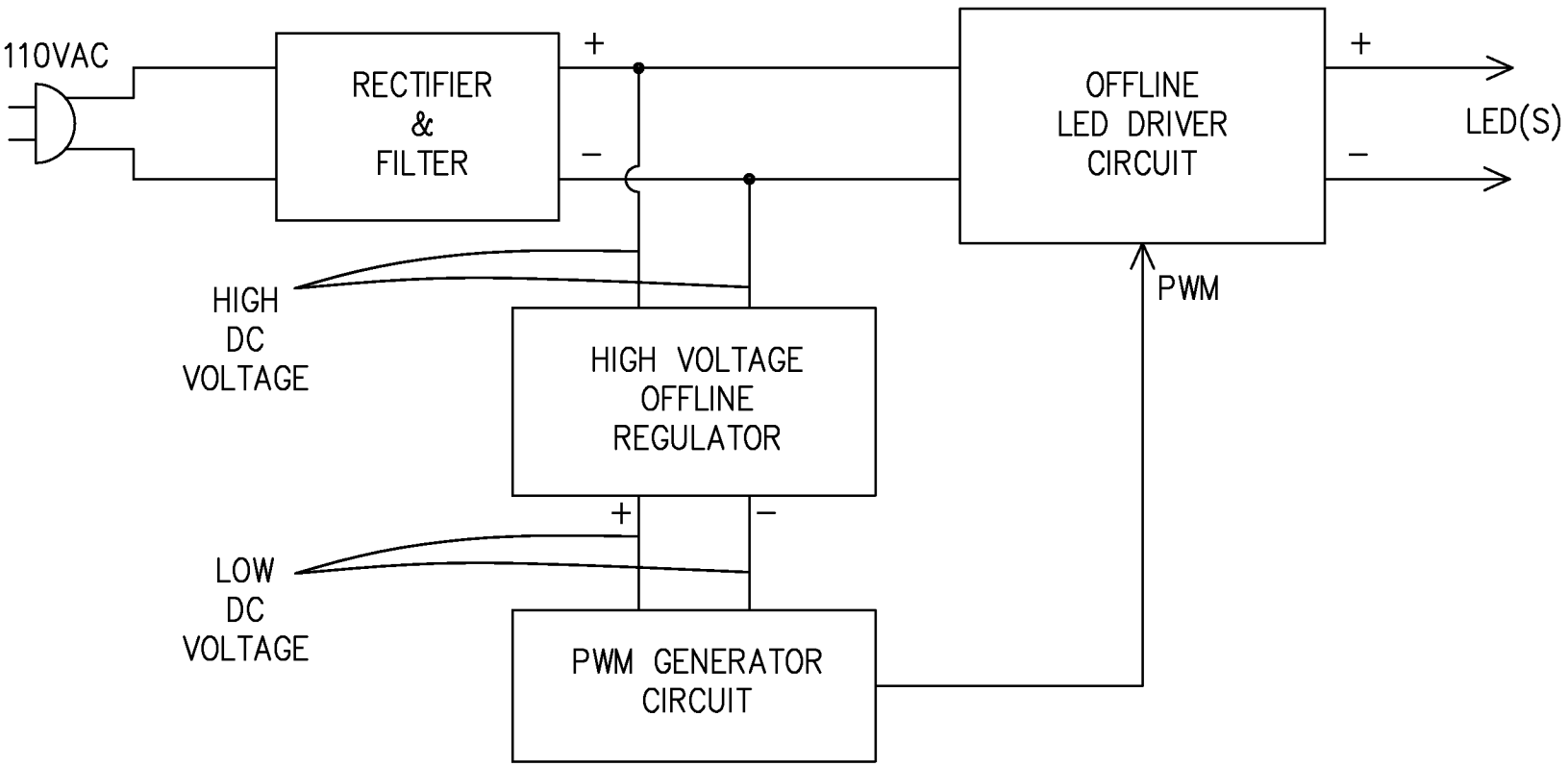
FIG. 10 is a simplified block diagram of the driver circuitry in accordance with another embodiment of the present invention.

If the offline LED driver circuit is not capable of providing a small DC voltage to power the PWM generator circuit, a small offline voltage regulator circuit may be employed to power the PWM generator circuit. FIG. 10 shows the block diagram of a circuit that uses an offline voltage regulator to power the PWM generator.

Figure 11:
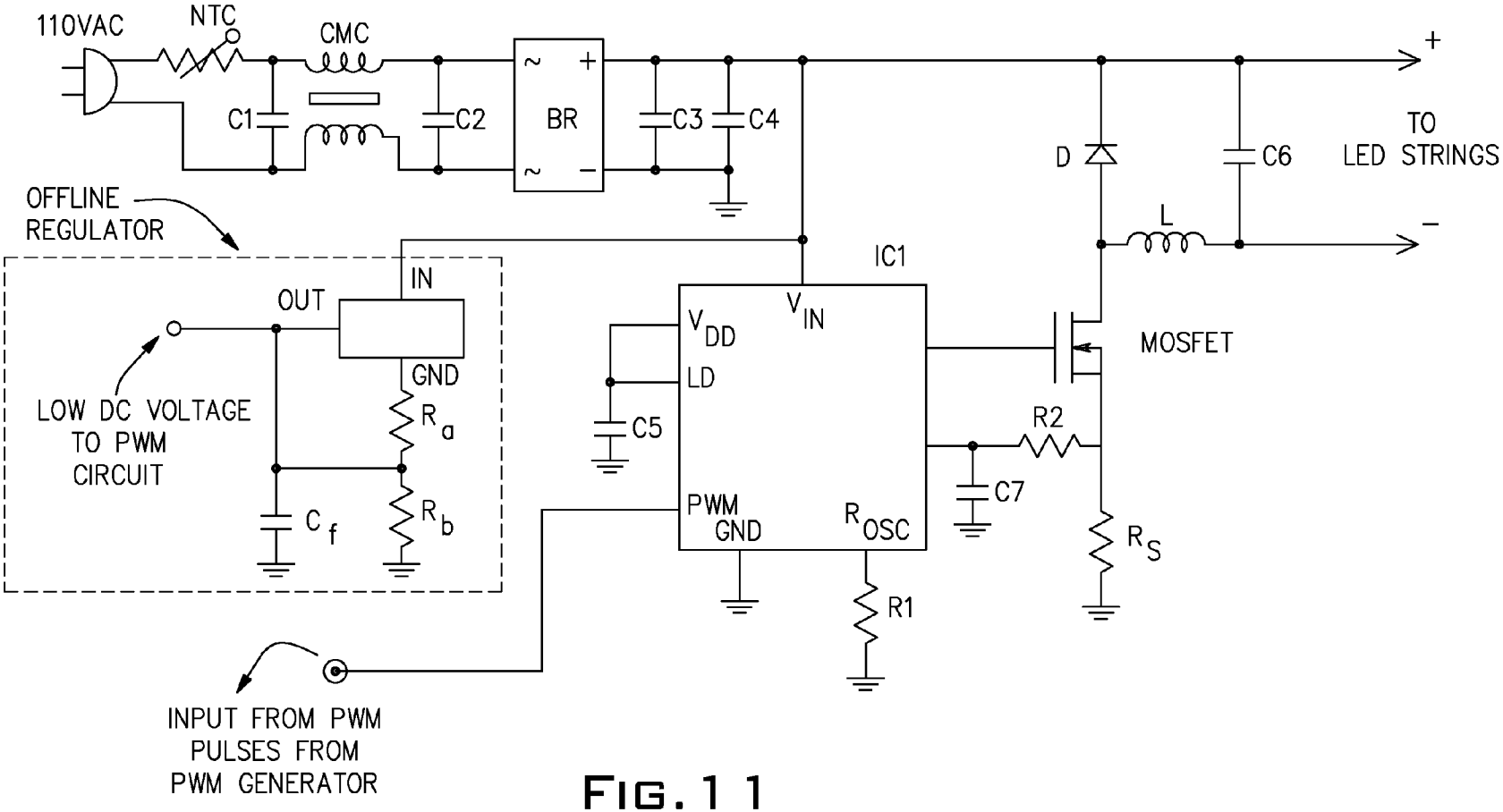
FIG. 11 is a schematic view of the driver circuitry for the block diagram of FIG. 10.

FIG. 11 shows a LED driver (of FIG. 10) that has an integrated high voltage offline regulator to power the PWM generator circuit. The offline regulator uses very few components. In the circuit of FIG. 11, Ra and Rb are used to set the output voltage of the offline regulator to the desired voltage suitable for powering the PWM circuit. The capacitor Cf is used for decoupling noise from the output voltage. One example of an offline regulator is LR8, offered by Supertex Inc. Sunnyvale, Calif.

One aspect of the present invention should now be apparent. Due to space limitations of the enclosures that mount in 110 volt AC outlets, the circuits that generate the PWM signal are not powered by transformers. Transformers are too bulky, and their output voltage needs to be rectified into DC so that it can power the PWM generators. The present invention integrates the PWM generator and the LED driver into a single assembly by using the low DC voltage from the LED driver circuit or from a small offline voltage regulator that is directly connected to the rectified line voltage. As such, the PWM circuit should consume very little current. The LED driver may be, for example 1¾"×2¾"×1¼" deep or smaller.

What is claimed is:

1. An LED driver for on/off and dimming of LEDs comprising a. a switching LED driver circuit adapted to directly connect to 110 volt AC mains and to rectify said AC current into a regulated low voltage DC output current to drive one or more LEDs;

b. a PWM generator including control means to generate a PWM signal with an adjustable duty cycle wherein the LEDs are dimmed by adjustment to the pulse width in the duty cycle;

c. a lead between the LED driver circuit and the PWM generator to provide a low voltage DC output to the PWM generator to supply power to the PWM generator;

d. an ON/OFF switch for serially connecting said PWM generator to said LED driver circuit to provide said driver circuit with said PWM signal, d.1 wherein said control means comprises analog components and a potentiometer operatively connected to said analog components, said potentiometer is operable by an end user;

d.2 said analog components comprising circuitry responsive to the potentiometer adapted to generate a PWM signal with a fixed frequency high enough to avoid eye detectable flickering and with a duty cycle having a modulated pulse width controlled by said potentiometer;

d.3 said LED driver circuit being adapted to generate a fixed frequency pulse at a frequency high enough to avoid eye detectable flickering in which the pulse width is modulated proportional to said PWM signal duty cycle to control LED brightness;

e. components "a", "b", "c", and "d" being an integrated unit sized small enough to fit within a standard 110 volt AC outlet box.

2. The LED driver of claim 1 wherein said PWM generator has a low power consumption that allows the generator to be powered by the low voltage supplied by the LED driver circuit and said on/off switch is integrated with said potentiometer.

3. The LED driver of claim 1 further including a 110 volt AC outlet box wherein said outlet box includes a cover plate and said control means is positioned in said cover plate, said LED driver being adapted to receive said 110 volt AC current from inside said outlet box.

4. The LED driver of claim 1 wherein said driver circuit has a capacity to power a cluster of LED large enough to provide chandelier lighting.

5. The LED driver of claim 4 wherein said driver circuit provides a regulated DC current equal to that required by said cluster of LEDs.

6. An LED driver for on/off and dimming of LEDs comprising a. a switching LED driver circuit adapted to directly connect to 110 volt AC mains and to rectify said AC current into a regulated low voltage DC output current to drive one or more LEDs;

b. a PWM generator to generate a PWM signal with an adjustable duty cycle, said PWM generator comprising b1. a microcontroller, b2. a control means comprising one or more momentary push-button ON/OFF switches, and b3. means operatively connecting said control means with said microcontroller, said microcontroller being programmed to monitor said switches for short and long closures wherein the duty cycle of the PWM signal is controlled by said microcontroller in response to short and long closures of said momentary switches, c. a lead between the LED driver circuit and the PWM generator to provide a low voltage DC output to the PWM generator to supply power to the PWM generator, d. means to provide said LED driver circuit with said PWM signal, said LED driver circuit generating a fixed frequency pulse in which a pulse width is modulated proportional to said PWM signal duty cycle to control LED brightness and the frequency is high enough to avoid eye detectable flickering, e. components "a", "b", "c", and "d" being an integrated unit sized small enough to fit within a 110 volt AC outlet box.

7. The LED driver of claim 6 further including a 110 volt AC outlet box and components "a", "b", "c", and "d" being within said outlet box, said LED driver being adapted to receive said 110 volt AC current from inside said control box.

8. The LED driver of claim 7 wherein said outlet box includes a cover plate and said control means is positioned in said cover plate.

9. The LED driver of claim 6 wherein said driver circuit has a capacity to power a cluster of LEDs large enough to provide chandelier lighting.

10. The LED driver of claim 9 wherein said driver circuit provides a regulated DC current equal to that required by said cluster of LEDs.

* * * * *